US007409912B2

(12) United States Patent
Cerovic et al.

(10) Patent No.: US 7,409,912 B2
(45) Date of Patent: Aug. 12, 2008

(54) SYSTEMS AND METHODS HAVING A POWER SUPPLY IN PLACE OF A ROUND OF AMMUNITION

(75) Inventors: Milan Cerovic, Phoenix, AZ (US); David K. DuBay, Casper, WY (US)

(73) Assignee: TASER International, Inc., Scottsdale, AZ (US)

( * ) Notice: Subject to any disclaimer, the term of this patent is extended or adjusted under 35 U.S.C. 154(b) by 241 days.

(21) Appl. No.: 10/892,083

(22) Filed: Jul. 14, 2004

(65) Prior Publication Data

US 2006/0027127 A1 Feb. 9, 2006

(51) Int. Cl.
*F41B 15/04* (2006.01)
*F41A 19/69* (2006.01)

(52) U.S. Cl. ..... 102/502; 361/232; 42/84; 42/1.08

(58) Field of Classification Search ..... 102/502, 102/293; 361/232; 89/28.05, 29, 28.2, 1.11, 89/1.1, 28.1; 42/1.08, 84, 105, 106, 77
See application file for complete search history.

(56) References Cited

U.S. PATENT DOCUMENTS 3,523,538 A * 8/1970 Shimizu ..... 607/58
3,803,463 A * 4/1974 Cover ..... 361/232
4,253,132 A * 2/1981 Cover ..... 361/232
4,656,946 A 4/1987 Gordon et al.
5,698,815 A * 12/1997 Ragner ..... 102/502
5,831,199 A * 11/1998 McNulty et al. ..... 89/1.11
5,930,935 A 8/1999 Griffin
5,962,806 A * 10/1999 Coakley et al. ..... 102/502
5,986,872 A 11/1999 Chaput
6,250,194 B1 6/2001 Brandl et al.
6,345,462 B1 2/2002 Mikuta et al.
6,481,145 B2 11/2002 Weichert et al.
6,668,700 B1 12/2003 Danner et al.
6,679,180 B2 * 1/2004 Warnagiris et al. ..... 102/502
6,782,789 B2 * 8/2004 McNulty, Jr. ..... 89/1.11
6,862,994 B2 * 3/2005 Chang ..... 102/502
6,877,434 B1 * 4/2005 McNulty, Jr. ..... 102/502
6,880,466 B2 * 4/2005 Carman ..... 102/502
7,042,696 B2 * 5/2006 Smith et al. ..... 361/232
7,057,872 B2 * 6/2006 Smith et al. ..... 361/232
7,096,792 B1 * 8/2006 Carman ..... 102/502
2004/0045207 A1 3/2004 McNulty et al.
2005/0024807 A1 * 2/2005 Cerovic et al. ..... 361/232
2005/0188593 A1 * 9/2005 Cerovic et al. ..... 42/77
2005/0188827 A1 * 9/2005 McNulty, Jr. ..... 89/1.11
2006/0026884 A1 * 2/2006 Cerovic et al. ..... 42/84

OTHER PUBLICATIONS

T'Prina Technology, "Stun Guns—An Independent Report," (1994).

* cited by examiner

*Primary Examiner*—James S Bergin
(74) *Attorney, Agent, or Firm*—William R. Bachand

(57) ABSTRACT

An apparatus for use in place of a round of percussion primed ammunition in a weapon includes a power supply and a switch. The switch is responsive to the mechanism in the weapon that fires the ammunition. Operation of the switch may enable the power supply to supply power to a replaceable cartridge. The cartridge may propel probes for delivering an incapacitating electrical charge from the power supply to the target. Another cartridge may include contacts to be applied without propellant to the target to stun the target. The apparatus may be inserted in the barrel of a weapon, for example, into the muzzle of a grenade launcher.

18 Claims, 6 Drawing Sheets

SYSTEMS AND METHODS HAVING A POWER SUPPLY IN PLACE OF A ROUND OF AMMUNITION

FIELD OF THE INVENTION

Embodiments of the present invention relate to systems and methods having a power supply in place of a round of ammunition.

BACKGROUND OF THE INVENTION

Conventional rifles may be used to deliver an electrical discharge device. Typically, the device comprises probes and a power supply that is propelled toward the target in a manner similar in some ways to propelling a bullet. The power supply cannot be reused for further launching of probes toward the target. In another conventional arrangement, an electrical discharge launching device is attached to a conventional rifle. Independent operating procedures are used with each weapon. Rifles employed by today's military frequently have mounted to them a secondary lethal force weapon, for example, a grenade launcher. Such secondary lethal force weapons make it difficult to attach a non-lethal force weapon to the soldier's rifle.

Today's military and police encounter situations where application of both lethal and non-lethal force is desirable. For example, in many of today's "hot-spots" around the world, military units perform crowd control duties involving a crowd that is initially relatively peaceful but then degenerates into a violent and dangerous mob. In such situations, a soldier may need a way to subdue violent elements in the crowd using non-lethal force while retaining a means for applying lethal force in order to further protect himself if the crowd becomes violent and dangerous. In these situations, soldiers typically hold one weapon at a time, the weapon of choice being some sort of lethal force weapon such as a rifle. When confronted with a situation where non-lethal force may be more appropriate, the soldier may not have a non-lethal weapon ready.

Consequently, there is a need to provide non-lethal force weapons simultaneously with lethal force weapons and integrate operation for ready access by a policeman or soldier.

SUMMARY OF THE INVENTION

An apparatus, according to various aspects of the present invention, may be installed in place of a round of percussion primed ammunition in a weapon. The weapon has a mechanism that activates percussion primed ammunition. The apparatus includes a power supply and a switch. The switch is responsive to the mechanism to enable the power supply to supply power. In another implementation, power is supplied to a replaceable cartridge. In response to the power supply, the cartridge delivers an incapacitating electrical charge to a target.

A multi-weapon system, according to various aspects of the present invention, includes a first weapon, a second weapon attached to the first weapon, and an apparatus for use in place of a round of percussion primed ammunition. The second weapon includes a mechanism for activating percussion primed ammunition. The apparatus includes a power supply and a switch. The switch is responsive to the mechanism to enable the power supply to supply power.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

A weapon, according to various aspects of the present invention, includes a mechanism for activating percussion primed ammunition that instead operates a power supply. Conventional weapons may be retrofitted for use as multi-function weapons: use for percussion primed ammunition; and use for other force delivery functions activated by the power supply.

A multi-function weapon delivers force for offensive or defensive purposes. Force is delivered in multiple ways at the discretion of the operator. Force in each way may be lethal or non-lethal. In a first example, a conventional multi-function weapon may include a rifle with an attached chemical discharge device. Operation of the rifle (e.g., loading and firing) is largely independent of operation of the chemical discharge device that has its own mechanisms for loading and firing, though aiming of each may be in common. In a second example, other conventional multi-function weapons having multiple independent firing mechanisms each for percussion fired ammunition. For example, a rifle may have a grenade launcher attached to it for common aiming. The rifle and grenade launcher each have an independent means for loading and firing.

According to various aspects of the present invention, a conventional weapon or a conventional multi-function weapon may be used as a multi-function weapon system by introducing in place of a round of percussion primed ammunition an assembly that comprises a power supply. Percussion primed ammunition includes, for example, a bullet, a ballistic launching cartridge (e.g., as used in a grenade launcher), and any cartridge activated by a mechanism for activating percussion primed ammunition (e.g., a chemical discharge device, a crowd control device). The power supply may be activated for any conventional purpose including supplying power for delivery of lethal or non-lethal force, supplying power for illuminating a target (e.g., for aiming using laser light, or viewing using infrared light), or supplying signals (e.g., wired or wireless, audio, digital, video) to other operators or equipment for communication or coordination of operation of other systems for offensive or defensive purposes.

Figure 1:
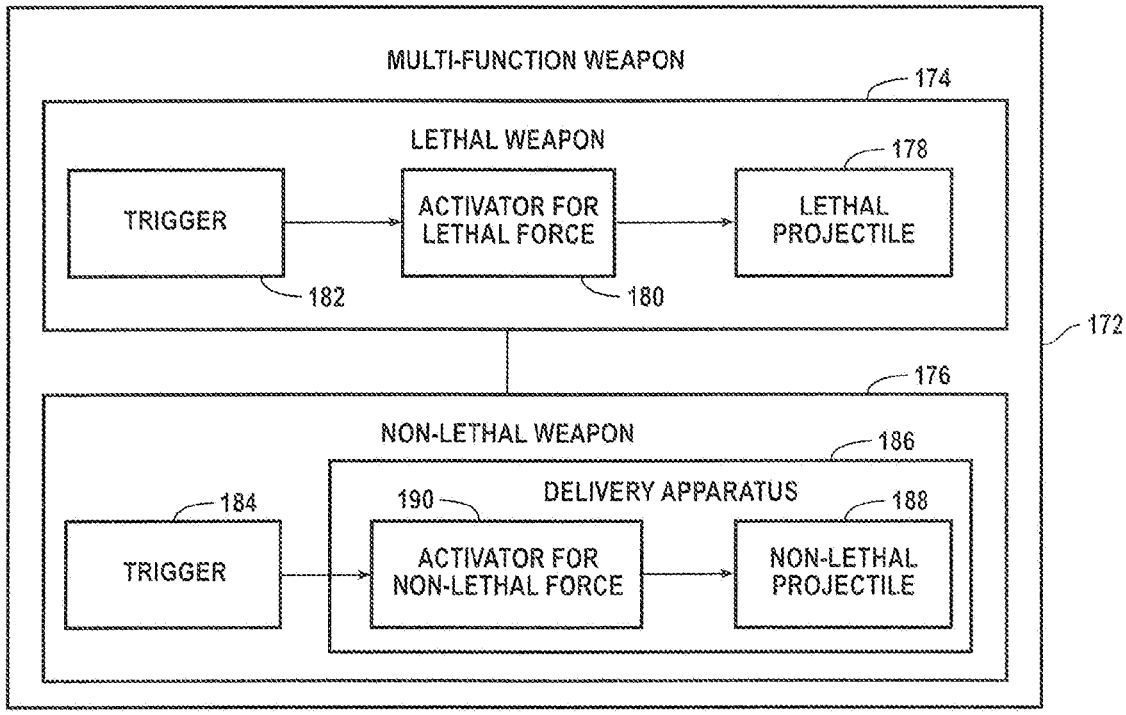
FIG. 1 is a functional block diagram of a multi-function weapon system according to various aspects of the present invention.

For example, multi-function weapon system 172 of FIG. 1 includes lethal force weapon 174 mechanically coupled to non-lethal force weapon 176. Lethal force weapon 174 includes trigger 182, activator for lethal force 180, and lethal projectile 178. Non-lethal weapon 176 includes trigger 184, and delivery apparatus 186. Delivery apparatus 186 includes activator for non-lethal force 190 and non-lethal projectile 188.

Lethal force weapon 174 delivers lethal projectile 178 to a target upon activation by trigger 182 of activator for lethal force 180. Lethal force weapon 174 may comprise any conventional firearm (e.g., shotgun, pistol, rifle, machine gun, mortar, rocket launcher, flame thrower, chemical discharge weapon); and projectile 178 may comprise any suitable conventional projectile (e.g., slug, shot, pellet, ball, bullet, rocket, particulate matter, liquid, gas). Activator 180 may be of the type to activate percussion primed ammunition; or may be any mechanism suitable for lethal projectile 178.

Non-lethal force weapon 176 may operate as a multi-function weapon. In a first mode of operation, weapon 176 may deliver conventional lethal force by use of percussion primed ammunition in place of delivery apparatus 186. In a second mode of operation, weapon 176 may deliver non-lethal force by use of delivery apparatus 186, introduced in place of a round of percussion primed ammunition. In both modes of operation, trigger 184 operates as a conventional trigger for percussion primed ammunition.

Delivery apparatus 186 delivers non-lethal projectile 188 at a target upon activation by trigger 184. In one implementation, activator for non-lethal force 190 includes a power supply that supplies power to non-lethal projectile 188. Projectile 188 delivers an electric charge to the target. Delivery apparatus 186 may be packaged as ammunition for any conventional loading technique; or, as an insert to be installed into the muzzle end of a barrel of weapon 176. Such an insert is herein referred to as an electrical weapon insert because a function of the reusable portion is to convert weapon 176 into an electrical weapon capable of delivering an electric charge to a target in any conventional manner.

In another implementation of multi-function weapon system 172, weapon 174 is omitted. Weapon 176 may provide, in various modes of operation, lethal and/or non-lethal force using percussion primed ammunition trigger 184, as discussed above.

An electrical weapon insert may deliver an electric charge to a target to incapacitate the target. This electric charge may be delivered to the target using one or more projectiles that are projected from the electrical weapon insert. The electrical weapon insert may be inserted into a barrel of a second weapon so that the firing mechanism of the second weapon may be used to cause the electrical weapon to deliver the electric charge to the target. In combination, the electrical weapon insert with the second weapon may form a multi-function weapon system.

The second weapon may be mounted to a third weapon capable of delivering a lethal or potentially lethal projectile, such as, for example, a bullet at the target. In combination, the second and third weapons may form a multi-function weapon. In combination, the multi-function weapon with the electrical weapon insert may form a multi-function weapon system.

A user of a multi-function weapon system, according to various aspects of the present invention, may choose to apply lethal force or non-lethal force (or both) to a target without having to pick up another weapon. It may be desirable to notify others in the vicinity of the operator that the operator intends to use non-lethal force. For example, it may be desirable for police working in teams to know that one of the team intends non-lethal force to coordinate providing additional non-lethal force as may be needed for the same target or another target. A multi-function weapon, according to various aspects of the present invention, may include any conventional device that provides notice for example a speaker for tones or voice, a light for color, brightness, or flashing indications, a radio voice message or data link. Such a device may be activated when a safety switch associated with the non-lethal delivery system is placed in an off position.

Figure 2A:
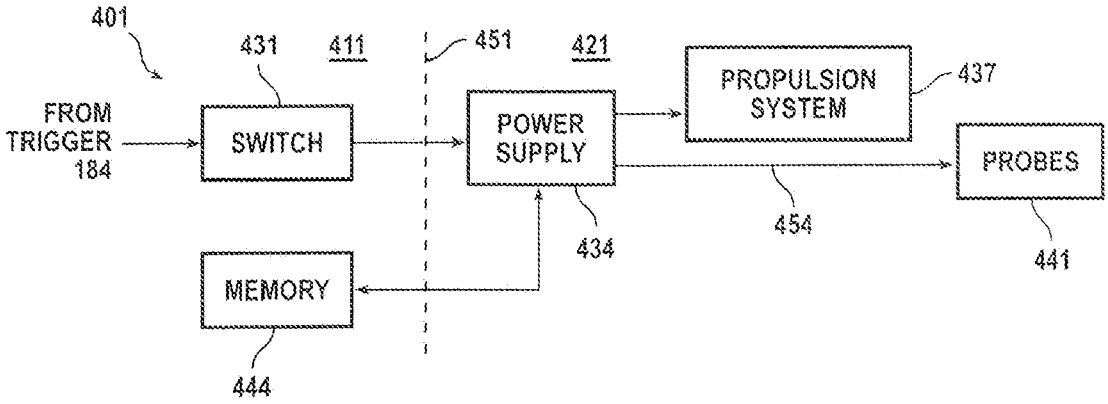
FIGS. 2A-2C are functional block diagrams of electrical discharge weapons, according to various aspects of the present invention, that may be used in place of the non-lethal weapon of FIG. 1.
Figure 2B:
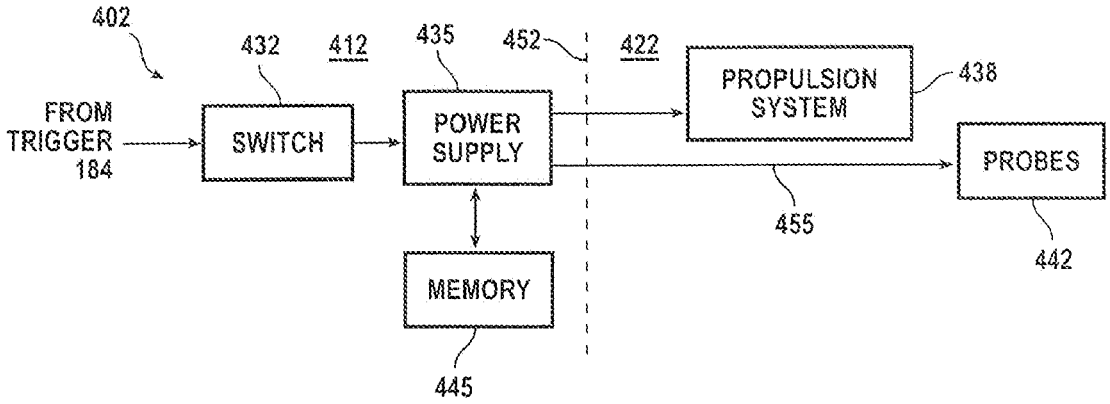
Figure 2C:
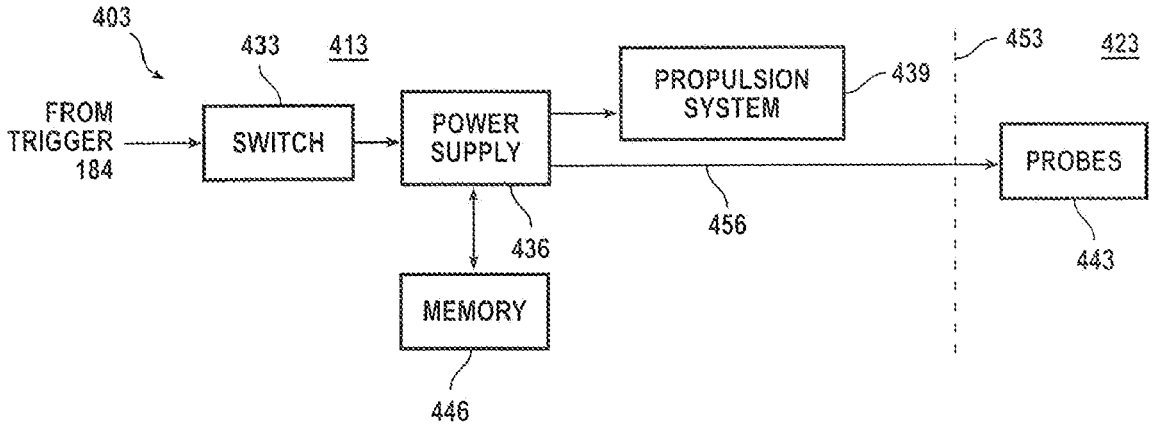

An electrical weapon insert in operation may include a reusable portion and a replaceable portion. The reusable portion is suitable for numerous operations; and, the replaceable portion, analogous to a round, may be suitable for a lesser quantity of operations (e.g., one shot from each replaceable portion). Trade-offs between economics and effectiveness of the electrical weapon may be met with several packaging solutions, according to various aspects of the present invention. For example, the electrical weapon inserts 401-403 described in FIGS 2A-2C include reusable portion 411-413 and replaceable portion 421-423. Each insert 401-403 includes a switch 431-433, a power supply 434-436, a propulsion system 437-439, probes 441-443, a memory 444-446, and an interface 451-453 between the reusable portion and the replaceable portion.

An interface as discussed herein accomplishes coupling between functions such as mechanical coupling and/or electrical coupling. An interface may facilitate replaceable parts, quick disconnect, and/or ease of manufacturing. An electrical interface may include contacts, plates (e.g., for capacitive coupling), or antenna (e.g., radio or magnetic coupling). For example, interface 451 of FIG. 2A may include wired coupling or telemetry between power supply 434 and memory 444 for storage or recall of data as discussed herein. Another interface 452-453 between the reusable portion and the replaceable portion (e.g., a cartridge) may include any conventional wired or wireless coupling (e.g., contacts, plates, antenna) 455-456 for coupling energy from power supply 435-436 to probes 442-443.

Switch 431-433 is operated by trigger 184 of weapon 176, discussed above. In one implementation, trigger 184 includes a mechanism that momentarily closes switch 431-433. Closing switch 431-433 activates power supply 434-436 for a predetermined duration sufficient for operation of the replaceable portion.

Power supply 434-436 may include a high voltage power supply for charging a capacitor that is later discharged through the target in a circuit that includes one or more probes 441-443. Any conventional power supply may be used. Power supply 434-436 may include a battery. In one implementation, power supply 434-436 includes a processor that governs timing of pulsed discharge through the target to accomplish incapacitation with little risk of disrupting vital functions in a human or animal target. All or a portion of power supply 434-436 may be propelled with probes 441-443.

Propulsion system 437-439 when activated by power supply 434-436 propels probes 441-443 away from the remainder of the replaceable portion and toward the target. Propulsion system 437-439 may include a pyrotechnic charge and an electrical igniter. Propulsion system 437-439 may include compressed gas. For instance, in weapon 403, a portion of the gas may be released for each launch of probes 443. Propulsion system 437-439 may be of the type described in U.S. Pat.

No. 5,078,117 to Cover, incorporated herein by reference. All or a portion of propulsion system 437-439 may be propelled with probes 441-443.

Memory 444-446 may provide operating instructions and/or parametric, values to power supply 434-436 governing the modes of operation and functions of electrical weapon insert 401-403. By governing power supply functions with memory contents, replaceable portions of several types may be used with reusable portions suitably equipped with compatible memory contents. Memory 444-446 may alternatively or in addition store a log. Each log entry may include the date and time electrical weapon insert 401-403 was used and/or the configuration of the weapon (e.g., weapon type replaceable portion type, battery capacity) during use or when changed (e.g., insert installed/removed, battery replaced). In another implementation, probes provide signals that may be analyzed by a processor of power supply 434-436 and results of analysis stored in memory 444-446.

In other implementations of electrical weapon insert 401-403, memory 444-446 is omitted with commensurate simplifications of power supply 434-436.

Probes 441-443 receive electricity 454-456 from power supply 434-436 and conduct electricity in a circuit through the target. Probes may be wired (e.g., by tethers) to power supply 434-436 during delivery of charge through the target. Probes may include one or more darts each tipped with one or more sharp spears to traverse clothing and stick into and remain in the target's skin during delivery of the charge.

Electrical weapon insert 401-403 may further include a light source powered through a switch (not shown) from power supply 434-436. The switch may be located for convenient manual operation on any external surface of electrical weapon insert 401-403.

For use in a linear weapon, the replaceable portion may be coupled to a distal end of the reusable portion. A proximal end of the reusable portion may be adapted for insertion into a barrel of a weapon suitable for any percussion primed ammunition, as discussed above. A switch may be located in the proximal end of the reusable portion for activating the replaceable portion upon being struck by a firing pin of the trigger mechanism of the weapon. For a cylindrical barrel, the reusable portion may have a generally cylindrical exterior. The reusable portion may be fixed in place in the barrel using conventional interference or fasteners for reliability of orientation. Sighting the linear weapon may be used for aiming the electric discharge weapon. The interface between the reusable portion and the replaceable portion may include conventional interference or fasteners for ease of replacement.

The reusable portion of the electrical weapon insert may be inserted into a barrel of a grenade launcher mounted to a rifle so that the replaceable portion is accessible at the distal end of the barrel. A user may move the grenade launcher barrel away from the firing assembly of the grenade launcher so that the barrel is spaced apart from firing assembly. The proximal end of the grenade launcher barrel is typically positioned adjacent a firing assembly of the grenade launcher. In operation, probes are discharged from the replaceable portion in response to operation of the firing assembly of the grenade launcher.

For example, multi-function weapon system 100 of FIGS. 3-8 includes firearm 200, grenade launcher 300, and electrical weapon insert 500.

Electrical weapon insert 500 comprises a replaceable portion 108 and a reusable portion 104. The replaceable portion 108 applies an electrical charge to a human or animal target to stun and/or immobilize the target with little risk of serious injury. A distal or front region of reusable portion 104 may have a socket 106 or cavity that receives replaceable portion 108. Replaceable portion 108 (also referred to as a cartridge) may include a plurality of projectiles (also referred to as probes) that may be discharged from the cartridge towards a target upon activation by the replaceable portion. Upon reaching the target, the projectiles may be utilized to provide an electric charge to a target and thereby immobilize the target. The cartridge 108 may include a releasable locking mechanism 110 such as a latch to releasably hold the cartridge in socket 106.

Reusable portion 104 may include a battery and means for access to the battery for battery replacement. For example, reusable portion 104 includes tube 105 and receiver 102. Receiver 102 includes collar 118 and fastener 120 (e.g., a screw). Fastener 120 extends into or through collar 118 to secure the distal end of tube 105 inside the collar.

Reusable portion 104 may include a light source for illuminating the target and/or aid in aiming the linear weapon and/or the electric discharge weapon. For example, light source 112 may be coupled to the reusable portion in any conventional manner. Light source 112 may be contained in a compartment 114 that has a transparent or translucent window 116. The compartment 114 may be located on a bottom region of receiver 102. Light source 112 may comprise a coherent light source (e.g., a laser) that may be used to aim electrical weapon insert 500 at a target. Light source 112 may include one or more light emitting diodes (LEDs) that may be used for illuminating an area in front of weapon system 100.

Figure 7:
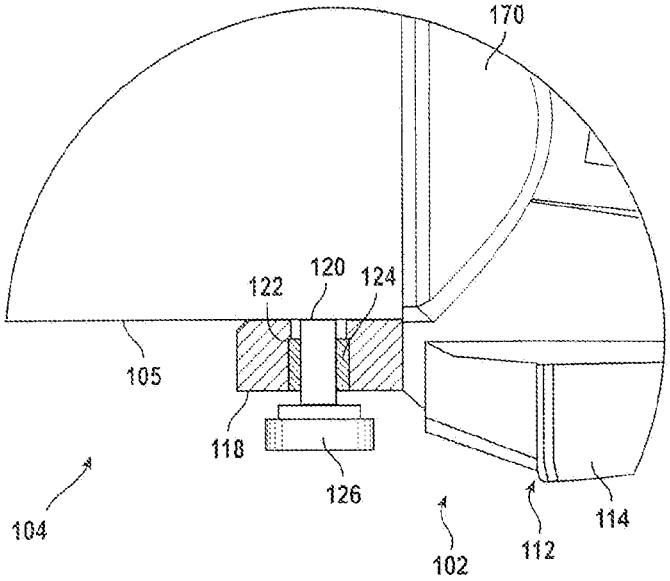
FIG. 7 is a cross section view of a portion of the reusable portion of FIG. 5.

Receiver 102 is coupled to a distal end (i.e., a front end) of tube 105. Receiver 102 may have a collar 118 (e.g., generally annular) that receives the distal end of tube 105. A fastener 120 such as a tightening screw may extend radially into collar 118 to help secure the distal end of tube 105 to receiver 102. As shown in FIG. 7, fastener 120 may extend through bore 122 in collar 118 so that fastener 120 abuts an exterior surface of tube 105 near the distal end of tube 105 to thereby engage tube 105 and hold the distal end of tube 105 in place inside collar 118. In another implementation, bore 122 may include threaded insert 124 that threadably engages corresponding threads on a threaded portion of fastener 120. Fastener 120 may further include head 126 for operation as a thumb screw. The circumference of head 126 may include finger engaging ridges for enhancing the user's grip when rotating fastener 120.

Figure 6:
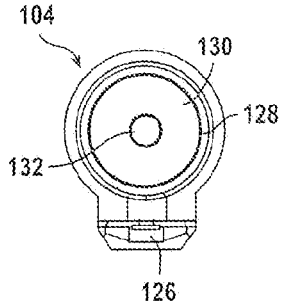
FIG. 6 is a rear view of the reusable portion of FIG. 5.

A proximal end 128 (i.e., a back end) of the reusable portion 104 is adapted for insertion into a barrel of a grenade launcher. In one embodiment, the reusable portion 104 may have a generally cylindrically-shaped exterior corresponding to a lumen of the grenade launcher barrel. The proximal end 128 of reusable portion 104 may include switch 130 corresponding to switch 431-433 discussed above. As shown in FIG.6. switch 130 may include an actuator 132 positioned to be struck by a firing pin of a firing assembly of a grenade launcher when the reusable portion 104 is inserted into the barrel of the grenade launcher.

A cartridge protects probes from mechanical damage prior to use. For example, cartridge 108 of FIG. 8 includes probes 146 and 148 (also referred to as darts). Each probe 146, 148 may have a pointed tip 150, 152 for insertion into a target. Tips 150, 152 may be barbed to help hold the tips 150, 152 to the target after insertion. Each probe 146, 148 may be electrically conductive and may be coupled to electrical weapon insert 500 by a flexible conductive filament 154, 156. As discussed above, power supply 434-436 may provide an electrical charge to probes 146, 148 via the filaments 154, 156 so that the electrical charge is applied to the target upon either close proximity to or contact with the probes 146, 148. Probes 146, 148 may be positioned in a vertical alignment in cartridge 108 so that one probe is located above the other probe (i.e., so that there is a top probe (e.g., probe 146) and a bottom probe (e.g., probe 148)) when electrical weapon insert 500 is positioned in a typical upright position for firing.

Prior to discharge, probes 146, 148 and filaments 154, 156 may be contained in a cavity 158 or compartment inside cartridge 108 that is covered by a removable cover. The cover may comprise a pair of blast doors 160, 162 that are blown away from cavity 158 by the discharge of probes 146, 148 out of cartridge 108.

Cavity 158 may also contain a plurality of tracking tags 164 having identifying information or indicia (e.g., an unique serial number) that identifies the associated cartridge 108. In use, as a result of probes 146, 148 being discharged from cartridge 108, tracking tags 164 are also expelled from cartridge 108 to permit subsequent identification of discharged cartridge 108 and a general location where cartridge 108 was discharged based on the identifying information contained on tracking tags 164 and the location where expelled tracking tags 164 land.

In an implementation having a light source 112 that comprises a coherent light source, a beam of coherent light emitted by light source 112 may be used to aim electrical weapon insert 500 at the intended target by illuminating the intended target. Coherent light source 112 may be aligned in a path generally parallel to the expected flight path of at least one of the probes (e.g., the top probe 146) so that a beam from light source 112 may be used to approximate an intended destination for the associated probe.

Firearm 200 may comprise a rifle, such as an M16-type rifle (e.g., a model M16A1), having a stock 202; a firing assembly 204 with a hand grip 206 and a trigger 208; and having a barrel 210 with a hand guard 212, a sight 214, and a bayonet mount 216 located beneath the sight 214.

Mounted beneath the firearm 200 is a grenade launcher 300 such as, for example, a M203-type grenade launcher capable of being mounted to a M16-type rifle. Details of the M203-type grenade launcher may be found in the following U.S. Department of the Army publications: Field Manual No. 3-22. 31 (FM 23-31) entitled "40-mm Grenade Launcher, M203" (available at http://www.globalsecurity.org/military/library/policy/army/fm/3-22-31/index.html), and Change 4 (TM 9-1010-221-10) to "Operator's Manual Grenade Launcher 40-mm, M203 (1010-00-179-6447)" (available at www.biggerhammer.net/manuals/tm9101022110.pdf) which are both incorporated herein by reference.

Figure 3:
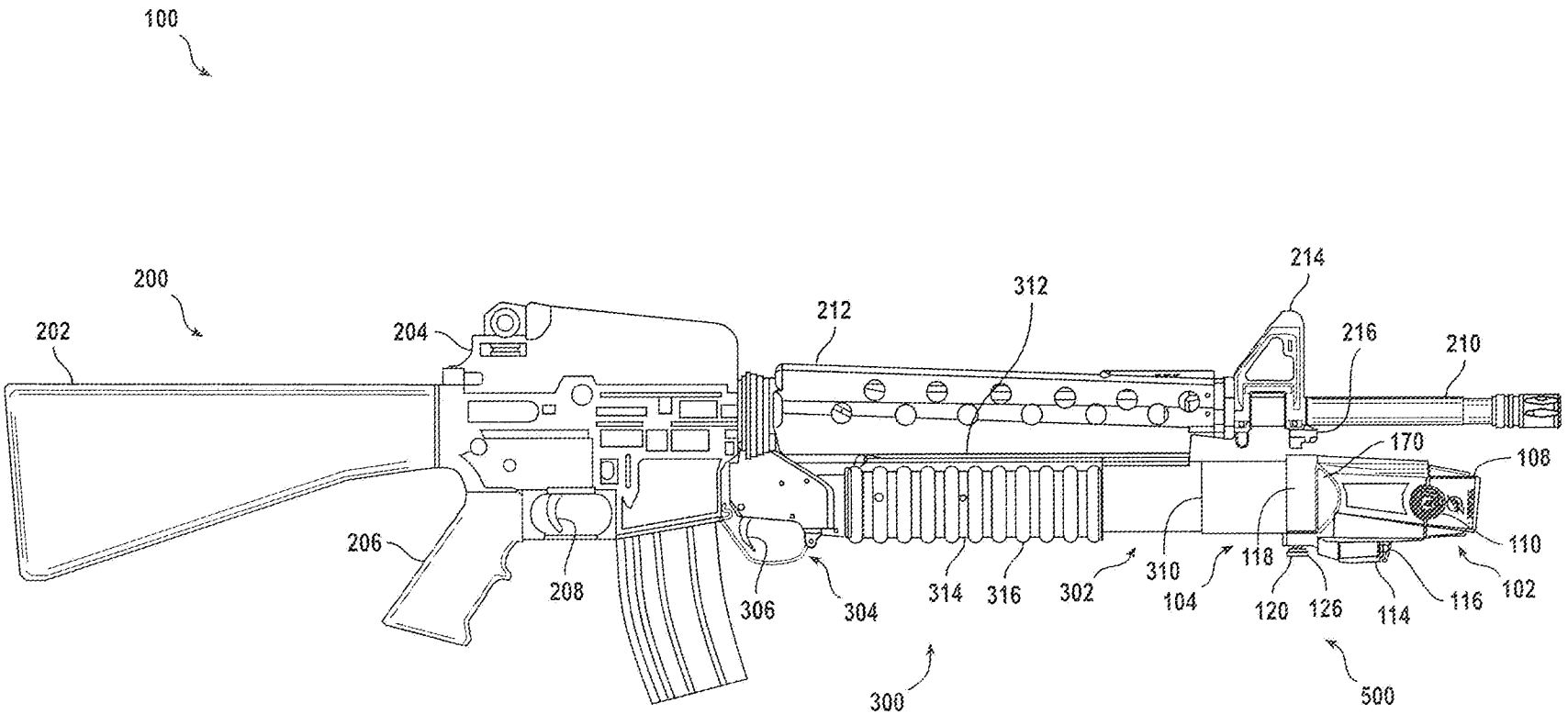
FIG. 3 is a side view of an exemplary multi-function weapon system of the type described in FIGS. 1-2C; the weapon having a grenade launcher being in the closed position, an insert installed in the grenade launcher, and a cartridge installed on the reusable portion.
Figure 4:
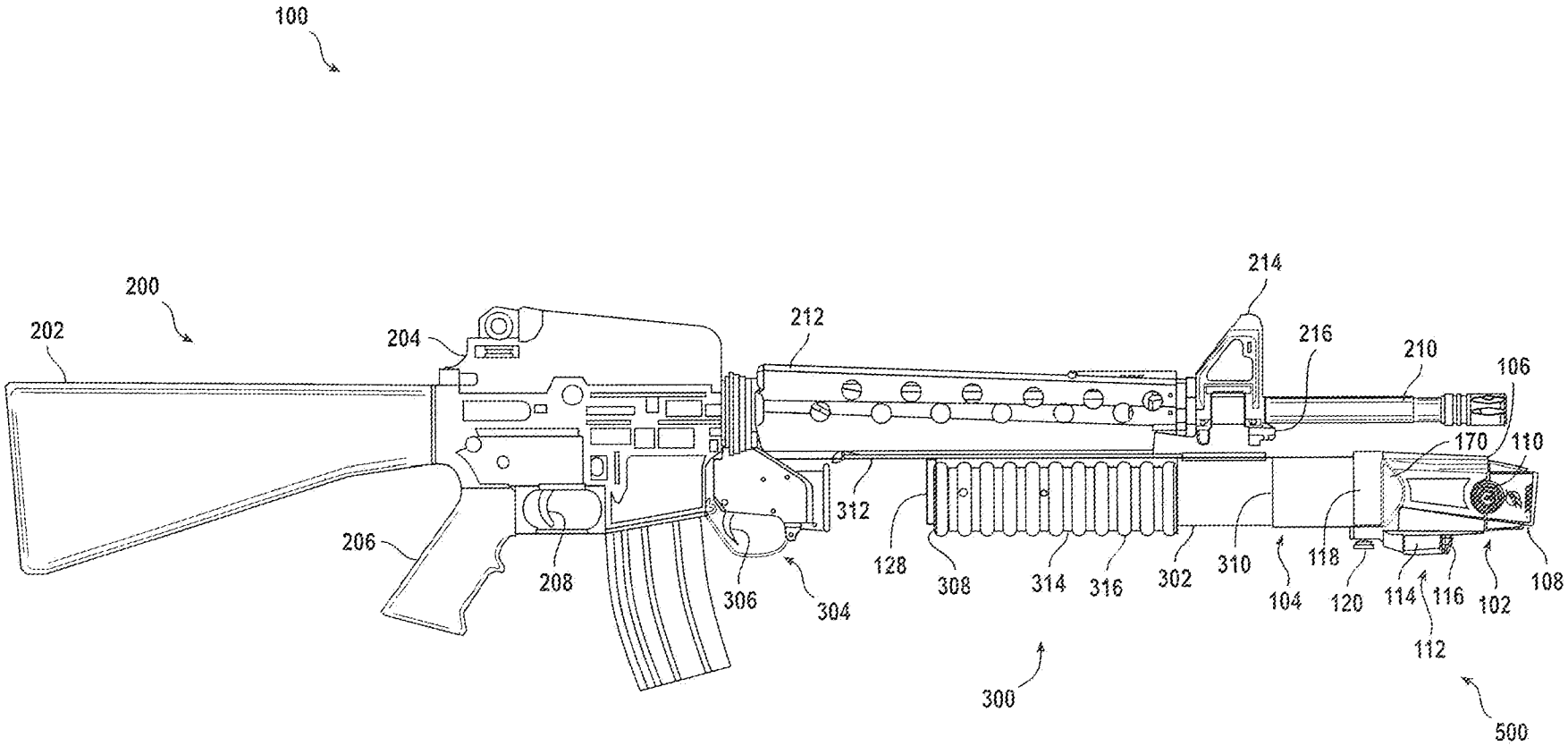
FIG. 4 is a side view of the multi-function weapon system of FIG. 3, the grenade launcher being in the open position.
Figure 5:
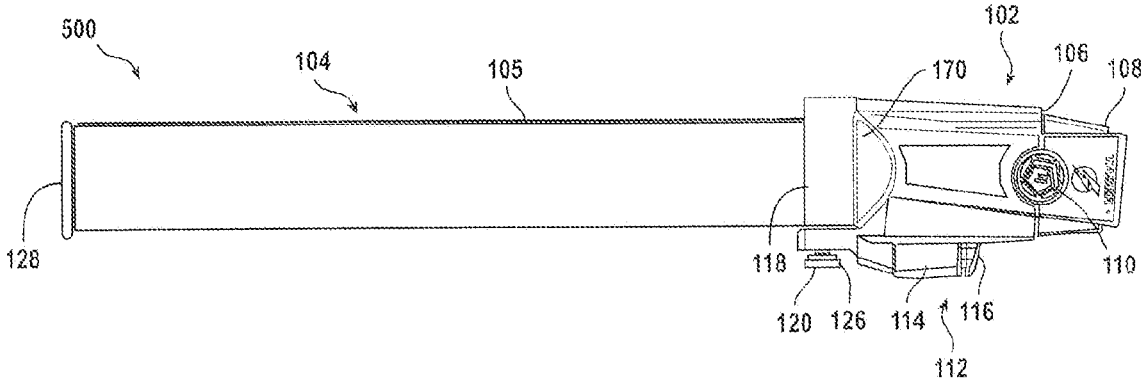
FIG. 5 is a side view of an exemplary insert with cartridge for use in the grenade launcher of the weapon of FIG. 3.

Grenade launcher 300 comprises a barrel 302 and a firing assembly 304. Firing assembly 304 includes a trigger/actuator 306 and a firing pin controlled by the trigger. Barrel 302 is generally tubular (e.g., cylindrical) in shape and has open proximal and distal ends 308, 310. Barrel 302 is slidably mounted to firearm 200 by a slide rail/groove combination 312 to permit sliding of the grenade launcher barrel 302 between a closed position (as shown in FIG. 3) and an open position (as shown in FIG. 4). Barrel 302 may include a handgrip 314 that has a plurality of generally ring-shaped finger grip ridges 316 for enhancing a user's grip when sliding barrel 302 along slide rail 312.

As shown in FIG. 3, when in the closed position, the proximal end 308 of barrel 302 is positioned adjacent firing assembly 304. Conversely, as shown in FIG. 4, proximal end 308 is spaced apart from firing assembly 304 when barrel 302 is positioned in the open position. In use, proximal end 308 of barrel 302 receives a grenade cartridge inserted into proximal end 308 when barrel 302 is in the open position. In the closed position, a grenade cartridge inserted into proximal end 308 abuts firing assembly 304. The grenade cartridge may be fired by pulling trigger 306 that causes a firing pin of firing assembly 304 to strike the grenade cartridge and thereby fire the grenade from barrel 302. To remove an expended grenade cartridge after firing, barrel 302 is slid back to the open position and the grenade cartridge is extracted from proximal end 308.

Figure 8:
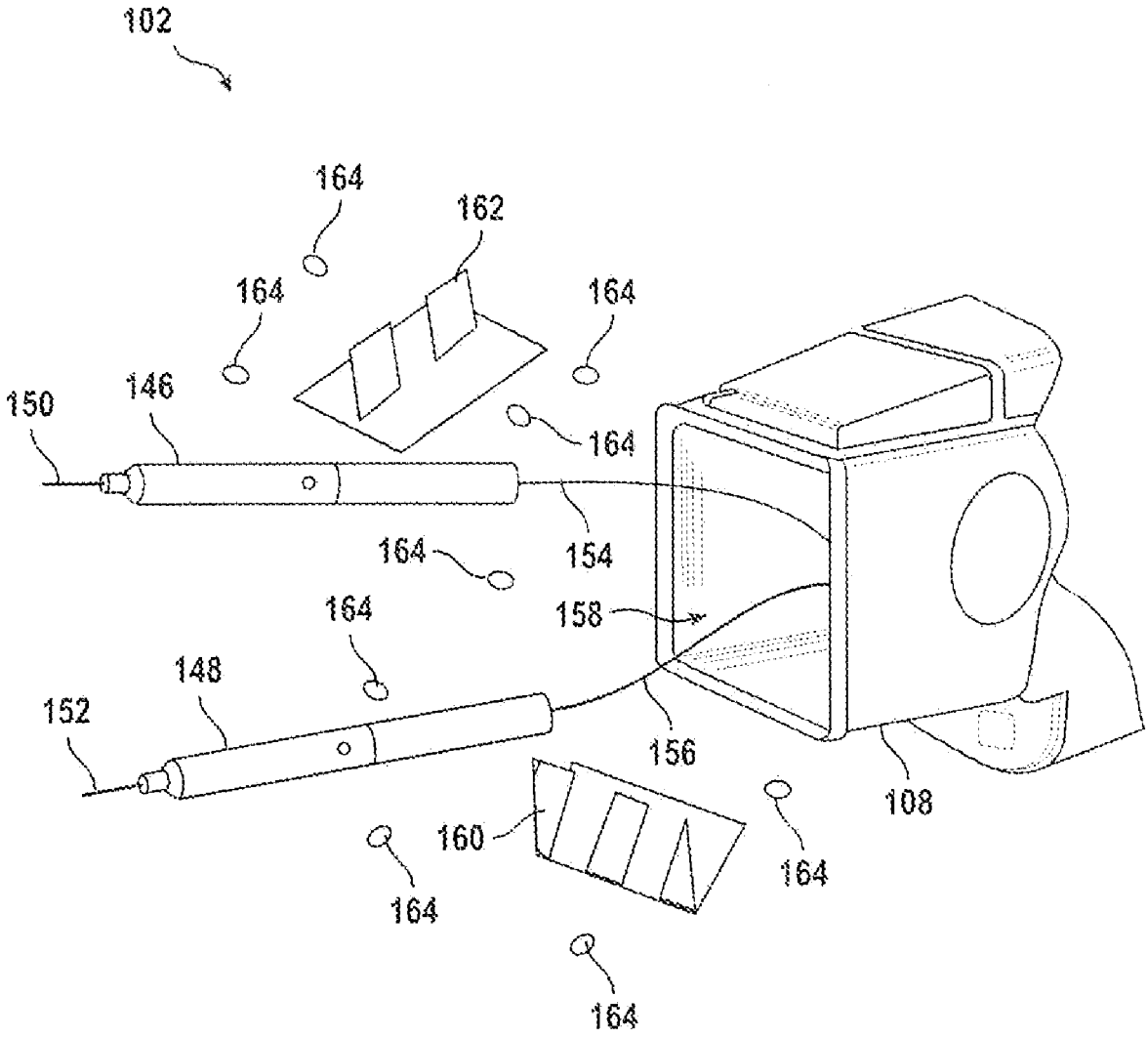
FIG. 8 is a perspective view of the cartridge of FIG. 3 shown after activation of the propulsion system.

Electrical weapon insert 500 is installed into grenade launcher 300 when barrel 302 is in the closed position. Collar 118 may be aligned with bayonet mount 216 of the rifle 200 when the reusable portion 104 is properly inserted into barrel 302. Such an arrangement may provide a convenient way for a user to insure that tube 105 and electrical weapon insert 500 are properly installed. Receiver 102 and light source 112 may be positioned in such a manner so that the short sides (i.e., the top and bottom sides) of receiver 102 are generally parallel with barrel 210 of rifle 200 with light source 112 positioned in a downwards direction from receiver 102. This alignment may be useful in an embodiment where cartridge 108 contains top and bottom probes (as shown in FIG. 8) so that the rifle's sight 214 may be utilized to help aim electrical weapon insert 500 at an intended target.

Collar 118 may have an outer diameter that extends beyond the outer diameter of barrel 302 and provide protection to barrel 302 from debris and other blow back, especially debris arising from the discharge of cartridge 108. Receiver 102 may include convex side regions 170 (opposite side not shown) adjacent to collar 118 to provide an oblique forward facing to collar 118 for enhancing deflection of debris and blow back.

With reference to FIGS. 3 and 6, switch 130 may be located at proximal end 128 of reusable portion 104 so that when barrel 302 is in the closed portion, the firing pin of firing assembly 304 may strike actuator 132 and thereby activate switch 130. To enhance the positioning and fit of proximal end 128 in barrel 302, proximal end 128 may be shaped to have an exterior profile that matches the exterior profile of a corresponding portion of a grenade cartridge.

FIG. 4 is a side view of an electrical weapon insert 500 inserted into a barrel 302 that is positioned in the open position. In the open position, a space is formed between the proximal end 308 of barrel 302 and firing assembly 304. In the open position, the firing pin of firing assembly 304 cannot strike actuator 132. A discharged cartridge 108 (i.e., a used or fired cartridge) may be more easily replaced with a new cartridge when barrel 302 is in the open position.

A method of installing electrical weapon insert 500 into rifle 200 having a grenade launcher 300 includes in any order: (a) placing the grenade launcher barrel 302 in the open position; (b) inserting into the distal end 310 of the barrel 302 the proximal end 128 of electrical weapon insert 500;(c) placing the grenade launcher barrel 302 in the closed position; and(d) verifying alignment of collar 118 with bayonet mount 216 of rifle 200. Verifying alignment assures that actuator 132 is brought into operating position with respect to firing assembly 304.

The foregoing description discusses preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below.

What is claimed is:

1. An apparatus for converting a weapon for percussion primed ammunition to an electronic weapon for incapacitating a human or animal target, the weapon having a mechanism for initiating propulsion away from the weapon of a projectile of a round, the apparatus for use with a cartridge, the apparatus comprising:

a tube;

a power supply supported by the tube; and a switch supported by the tube and located by the tube to be operated by the mechanism of the weapon; wherein the tube has a form that allows the tube, the power supply, and the switch as a unit to replace the round when the round is removed from the weapon;

when the apparatus is replacing the round, the apparatus is not propelled as a projectile from the weapon in response to operation of the mechanism of the weapon; and an operation of the switch enables the power supply to supply power to the cartridge for delivering an incapacitating electrical charge to the target.

2. The apparatus of claim 1 wherein the switch enables the power supply in response to being struck by a firing pin of the mechanism.

3. The apparatus of claim 1 wherein the power supply comprises a battery.

4. The apparatus of claim 1 further comprising an interface between the power supply and the cartridge, the interface providing mechanical coupling between the apparatus and the cartridge, and the interface providing electrical coupling between the power supply and the cartridge.

5. The apparatus of claim 4 wherein the interface comprises a contact that conducts electricity from the power supply to the cartridge.

6. The apparatus of claim 4 wherein the tube further supports the cartridge.

7. The apparatus of claim 6 wherein:

the cartridge comprises an electrically primed propellant to propel the probe toward the target; and the power supply is coupled to the cartridge to provide electrical power to activate the propellant.

8. The apparatus of claim 1 further comprising a propulsion system to propel a probe of the cartridge toward the target, the propulsion system responsive to the switch.

9. The apparatus of claim 1 further comprising a fastener to attach the apparatus to the weapon.

10. The apparatus of claim 1 further comprising a device operative to assist aiming of the weapon.

11. The apparatus of claim 1 further comprising a device operative to signal subsequent use of the cartridge, for alerting humans in the vicinity of the weapon.

12. The apparatus of claim 1 further comprising:

a circuit that provides indicia of time; and a memory that stores the indicia of time in response to operation of the switch.

13. The apparatus of claim 1 wherein the power supply provides power via a contact to the cartridge.

14. The apparatus of claim 1 wherein the form allows the tube, the power supply, and the switch as a unit to replace a bullet when the bullet is removed from the weapon.

15. The apparatus of claim 1 wherein the form allows the tube, the power supply, and the switch to replace as a unit a ballistic launching cartridge when the ballistic launching cartridge is removed from the weapon.

16. The apparatus of claim 1 wherein the tube has a form that allows the tube, the power supply, and the switch to be inserted as a unit at least in part into a barrel of the weapon for mechanical coupling of the mechanism and the switch.

17. The apparatus of claim 1 wherein the tube has a form that allows the tube, the power supply, and the switch to be inserted as a unit at least in part into a barrel, otherwise for launching grenades from the weapon, and allows for mechanical coupling of the mechanism and the switch.

18. An electronic weapon comprising:

the apparatus of claim 1; and the weapon combined with the apparatus.

* * * * *

UNITED STATES PATENT AND TRADEMARK OFFICE

CERTIFICATE OF CORRECTION

PATENT NO. : 7,409,912 B2
APPLICATION NO. : 10/892083
DATED : August 12, 2008
INVENTOR(S) : Milan Cerovic et al.

It is certified that error appears in the above-identified patent and that said Letters Patent is hereby corrected as shown below:

Column 5, line 5, after “parametric” delete “,”.

Column 5, line 13, after “weapon type” insert -- , --.

Column 6, line 52, delete “FIG.6.” and insert -- FIG.6, --, therefor.

Column 10, line 14, in Claim 12, before “operation” insert -- an --.

Signed and Sealed this
Twenty-seventh Day of September, 2011

David J. Kappos

David J. Kappos
*Director of the United States Patent and Trademark Office*